US011668469B2

(12) United States Patent
Cadima

(10) Patent No.: US 11,668,469 B2
(45) Date of Patent: Jun. 6, 2023

(54) COOKTOP APPLIANCE AND HEATING ELEMENT HAVING A THERMOSTAT

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 536 days.

(21) Appl. No.: 16/748,926

(22) Filed: Jan. 22, 2020

(65) Prior Publication Data

US 2021/0222883 A1 Jul. 22, 2021

(51) Int. Cl.
*F24C 7/08* (2006.01)

(52) U.S. Cl.
CPC ..... *F24C 7/081* (2013.01); *F24C 7/088* (2013.01)

(58) Field of Classification Search
CPC ..... F24C 15/105; F24C 7/083; F24C 7/081; F24C 7/088
See application file for complete search history.

(56) References Cited

U.S. PATENT DOCUMENTS

| | | | | |
|---|---|---|---|---|
| 2,806,122 | A * | 9/1957 | Thunander | G05D 23/1913 219/459.1 |
| 4,241,289 | A * | 12/1980 | Bowling | F24C 15/105 374/165 |
| 4,812,624 | A | 3/1989 | Kern | |
| 6,246,033 | B1 | 6/2001 | Shah | |
| 6,753,509 | B2 | 6/2004 | Gratz et al. | |
| 8,723,085 | B2 * | 5/2014 | Callahan | F24C 7/087 219/448.11 |
| 2008/0264926 | A1 | 10/2008 | Peng | |
| 2018/0238559 | A1 | 8/2018 | Pasqual et al. | |
| 2019/0113238 | A1 | 4/2019 | Gomez et al. | |

FOREIGN PATENT DOCUMENTS

| | | | |
|---|---|---|---|
| CN | 1133435 | A | 10/1996 |
| CN | 201391917 | Y | 1/2010 |
| CN | 203564085 | U * | 4/2014 |
| CN | 206252382 | U | 6/2017 |
| GB | 2414559 | B | 8/2007 |
| JP | 6017498 | B2 | 11/2016 |

* cited by examiner

*Primary Examiner* — Thien S Tran
(74) *Attorney, Agent, or Firm* — Dority & Manning, P.A.

(57) ABSTRACT

A cooktop appliance or heating element, as provided herein, may include a sensor support assembly positioned within a heating zone of the heating element. The sensor support assembly may include a shroud cover and a thermostat. The thermostat may be mounted to the shroud cover. The thermostat may include a base and a top cap held on the base. The top cap may be positioned above the shroud cover and spaced apart therefrom. A vertical air gap may be defined between the top cap and the shroud cover.

20 Claims, 6 Drawing Sheets

COOKTOP APPLIANCE AND HEATING ELEMENT HAVING A THERMOSTAT

FIELD OF THE INVENTION

The present subject matter relates generally to electric heating elements for appliances, such as for cooktop or range appliances.

BACKGROUND OF THE INVENTION

Cooking appliances that include a cooktop traditionally have at least one heating element (e.g., electric coil heating element) positioned on a panel proximate a cooktop surface for use in heating or cooking an object, such as a cooking utensil, and its contents. Recent regulatory requirements mandate that electric coil heating elements on cooktop appliances be incapable of heating cooking oil to an oil ignition temperature. Thus, certain electric coil heating elements utilize a bimetallic thermostat to interrupt power to the coil when the thermostat reaches a tripping point. In some cooktops, the thermostat is remotely positioned from the cookware and infers the cookware temperature through correlation. In other cooktops, the thermostat contacts a bottom of the cookware to improve correlation. However, whether remotely positioned from the cookware or contacting the cookware, imperfect correlation requires conservative thermostat calibrations and thus results in reduced performance.

Known coil heating elements using bimetallic thermostats have shortcomings. In particular, the flatness of the coil has a significant impact to system performance, as does the flatness of the bottom of the cookware. Poor contact between the cookware and the coil cause the portions of the coil that have poor conduction to the cookware to glow red hot and radiate heat. Radiative heat transfer from the coil to the thermostat can overcome the heat transfer from the cookware to the thermostat, causing the thermostat to trip early.

As a result, it would be useful to have a cooktop appliance addressing one or more of the above identified issues. In particular, it may be advantageous to provide a cooktop appliance having a thermostat with one or more features for enhancing contact (e.g., with a utensil on a heating element) or conductive heat transfer from a utensil to a thermostat (e.g., without being unduly affected by radiative heat transfer from the heating element).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an electric resistance heating coil assembly is provided. The electric resistance heating coil assembly may include a spiral wound sheathed heating element, a thermostat, and a shroud cover. The spiral wound sheathed heating element may have a first coil section and a second coil section. The thermostat may include a base and a top cap held on the base. The thermostat may be connected in series between the first and second coil sections of the spiral wound sheathed heating element. The thermostat may be spring loaded such that a distal end of the thermostat is urged away from a top surface of the spiral wound sheathed heating element. The shroud cover may be mounted to the thermostat below the top cap.

The shroud cover may be spaced apart from the top cap. A vertical air gap may be defined between the top cap and the shroud cover.

In another exemplary aspect of the present disclosure, a cooktop appliance is provided. The cooktop appliance may include a heating element and a sensor support assembly. The heating element may define a heating zone. The sensor support assembly may be positioned within the heating zone of the heating element. The sensor support assembly may include a shroud cover and a thermostat. The thermostat may be mounted to the shroud cover. The thermostat may include a base and a top cap held on the base. The top cap may be positioned above the shroud cover and spaced apart therefrom. A vertical air gap may be defined between the top cap and the shroud cover.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
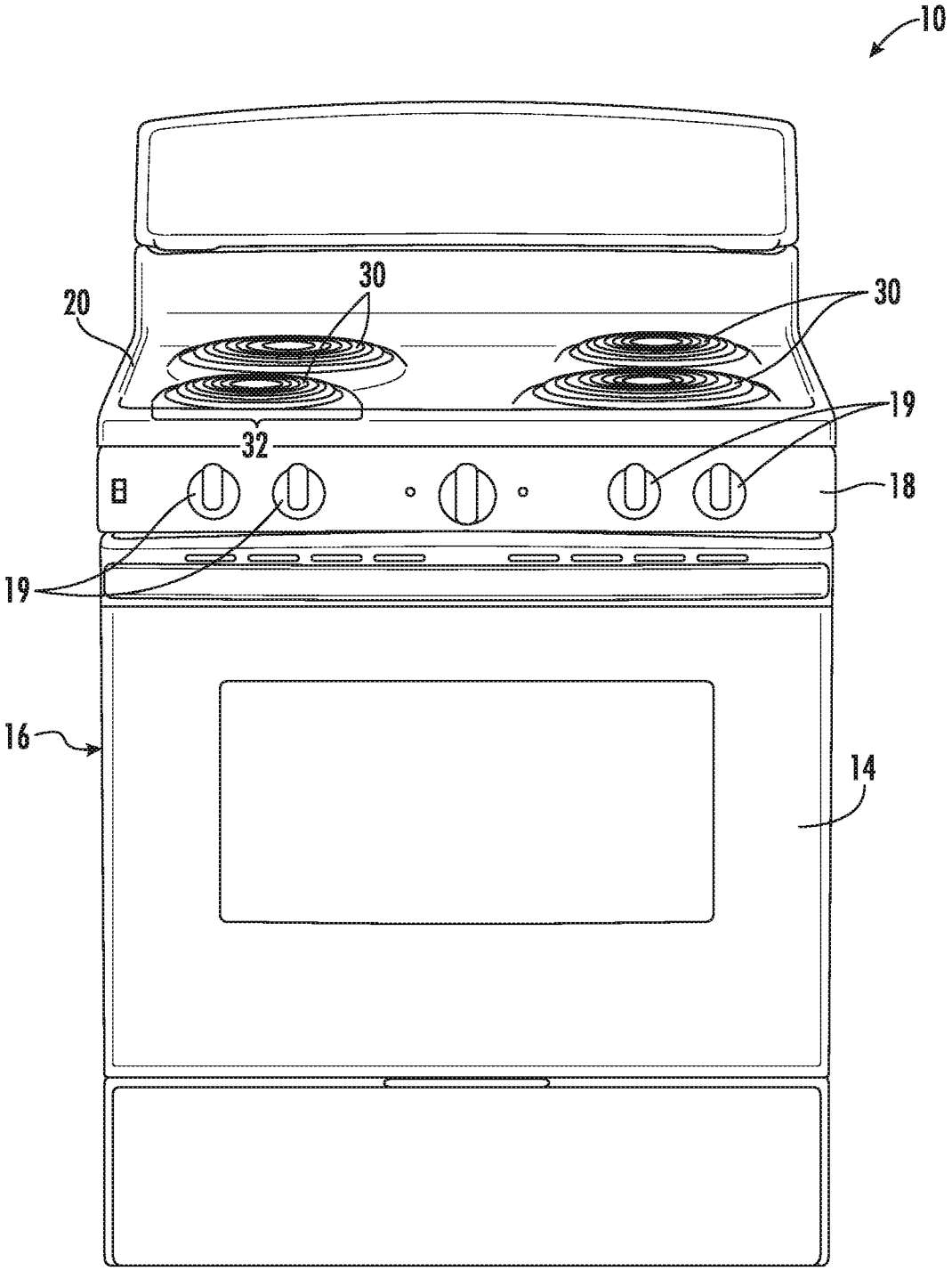
FIG. 1 provides a front, perspective view of a range appliance according to exemplary embodiments of the present disclosure.
Figure 2:
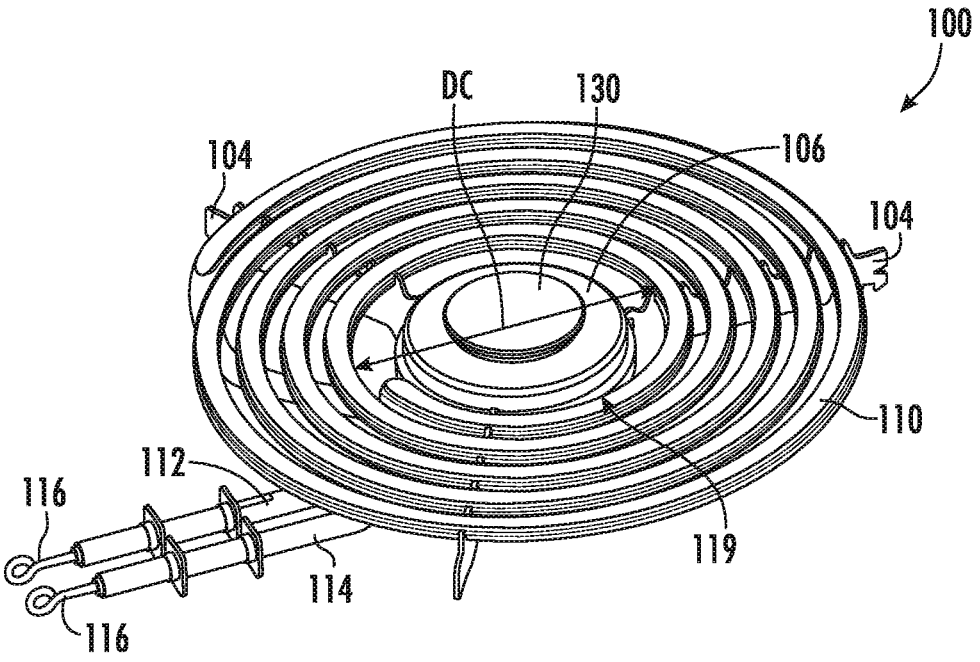
FIG. 2 provides a top, perspective view of an electric resistance heating coil assembly of the exemplary range appliance of FIG. 1.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Turning now to the figures, FIG. 1 provides a front, perspective view of a range appliance 10 according to exemplary embodiments of the present disclosure. Range appliance 10 is provided by way of example only and is not intended to limit the present subject matter to the particular arrangement shown in FIG. 1. Thus, the present subject matter may be used with other cooktop appliance configurations (e.g., double oven range appliances, standalone cooktop appliances, etc.).

Generally, a top panel 20 of range appliance 10 includes one or more heating elements 30. Heating elements 30 may be, for example, electrical resistive heating elements. Range appliance 10 may include only one type of heating element 30, or range appliance 10 may include a combination of different types of heating elements 30, such as a combination of electrical resistive heating elements and gas burners. Further, heating elements 30 may have any suitable shape and size, and a combination of heating elements 30 of different shapes and sizes may be used.

Generally, each heating element 30 defines a heating zone 32 on which a cooking utensil, such as a pot, pan, or the like, may be placed to cook or heat food items placed in the cooking utensil. In some embodiments, range appliance 10 also includes a door 14 that permits access to a cooking chamber 16 of range appliance 10 (e.g., for cooking or baking of food items therein). A control panel 18 having controls 19 permits a user to make selections for cooking of food items—although shown on a front panel of range appliance 10, control panel 18 may be positioned in any suitable location. Controls 19 may include buttons, knobs, and the like, as well as combinations thereof. As an example, a user may manipulate one or more controls 19 to select a temperature or a heat or power output for each heating element 30.

Figure 3:
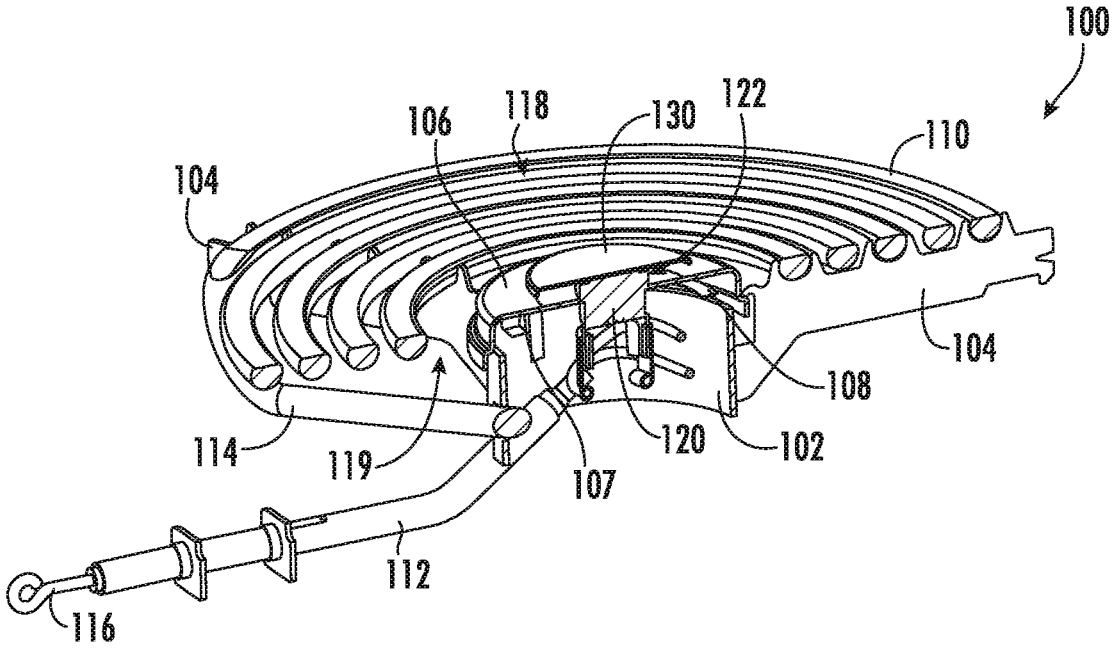
FIG. 3 provides a sectional view of the exemplary electric resistance heating coil assembly of FIG. 2.
Figure 4:
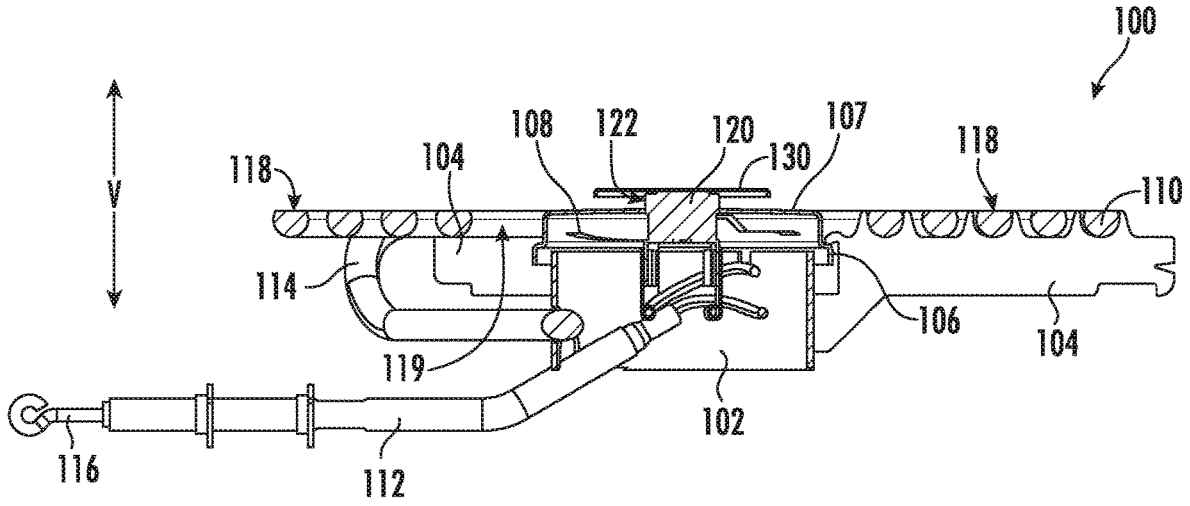
FIG. 4 provides a sectional view of the exemplary electric resistance heating coil assembly of FIG. 2.
Figure 6:
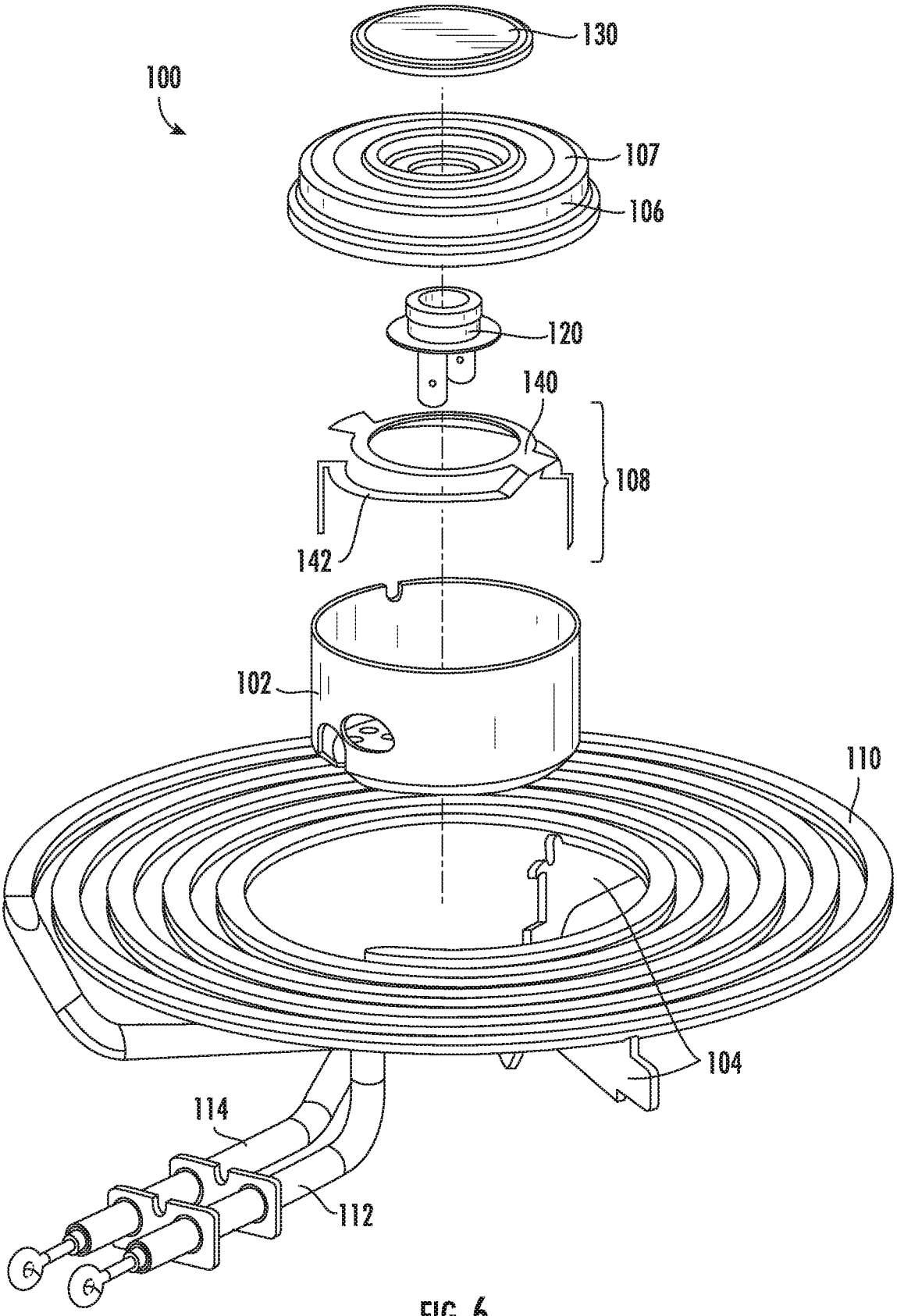
FIG. 6 provides an exploded perspective view of a portion of the exemplary heating coil assembly of FIG. 2.

Turning now to FIGS. 2 through 4 and 6, FIG. 2 provides a top, perspective view of an electric resistance heating coil assembly 100 of range appliance 10. FIGS. 3 and 4 provide sectional views of electric resistance heating coil assembly 100. FIG. 6 provides an exploded perspective view of a portion of electric resistance heating coil assembly 100. Electric resistance heating coil assembly 100 may be used as one or more of heating elements 30 in range appliance 10. However, while described in greater detail below in the context of range appliance 10, it will be understood that electric resistance heating coil assembly 100 may be used in or with any suitable cooktop appliance in alternative example embodiments. As discussed in greater detail below, electric resistance heating coil assembly 100 includes features for facilitating conductive heat transfer between a thermostat (e.g., bimetallic thermostat 120) and a utensil positioned on electric resistance heating coil assembly 100.

As shown, some embodiments of electric resistance heating coil assembly 100 include a spiral wound sheathed heating element 110. Spiral wound sheathed heating element 110 may include a first coil section 112 and a second coil section 114. In certain embodiments, spiral wound sheathed heating element 110 also has a pair of terminals 116. Each of first and second coil sections 112, 114 may be directly coupled or connected to a respective terminal 116. A voltage differential across terminals 116 induces an electrical current through spiral wound sheathed heating element 110, and spiral wound sheathed heating element 110 may increase in temperature by resisting the electrical current through spiral wound sheathed heating element 110.

Within the heating zone 32, a sensor support assembly, including thermostat 120, is positioned. When assembled, bimetallic thermostat 120 is connected, for example, in series between first and second coil sections 112, 114 of spiral wound sheathed heating element 110. Bimetallic thermostat 120 opens and closes in response to a temperature of bimetallic thermostat 120. For example, bimetallic thermostat 120 may be spring loaded such that a distal end 122 of bimetallic thermostat 120 is urged away from a top surface 118 of spiral wound sheathed heating element 110. Thus, distal end 122 of bimetallic thermostat 120 may be urged towards a utensil (not shown) positioned on top surface 118 of spiral wound sheathed heating element 110. Bimetallic thermostat 120 may measure the temperature of the utensil on top surface 118 of spiral wound sheathed heating element 110 due to heat transfer between the utensil and bimetallic thermostat 120. As discussed in greater detail below, electric resistance heating coil assembly 100 includes features for facilitating conductive heat transfer between the utensil on top surface 118 of spiral wound sheathed heating element 110 and bimetallic thermostat 120.

Sensor support assembly may also include a shroud 102 and coil support arms 104. Coil support arms 104 extend (e.g., radially) from shroud 102, and spiral wound sheathed heating element 110 is positioned on and supported by coil support arms 104. Coil support arms 104 may rest on top panel 20 to support electric resistance heating coil assembly 100 on top panel 20. Bimetallic thermostat 120 may be mounted to a shroud cover 106 below top cap 126. For instance, a support flange 128 of thermostat 120, which may extend radially from base 124 or below top cap 126, may be joined to shroud cover 106 (e.g., on a top wall 107 of shroud cover 106). When assembled, support flange 128 may be positioned below at least a portion of heating element 110 (e.g., below top surface 118). Moreover, shroud cover 106 is positioned below top cap 126. Additionally or alternatively, shroud cover 106 may extend over shroud 102. In particular, a top of shroud 102 may be nested in shroud cover 106. When assembled, shroud 102, including shroud cover 106, generally shields bimetallic thermostat 120 from at least a portion of the heat generated at spiral wound sheathed heating element 110.

Optionally, shroud 102, including shroud cover 106, is formed from a relatively low thermal conductivity metal (e.g., steel or a steel alloy). Additionally or alternatively, support flange 128 may be formed from a common material with and joined, for example, to shroud cover 106 (e.g., via welding or a suitable mechanical fastener, such as a screw or rivet). Also additionally or alternatively, support flange 128 and top cap 126 are formed of, or include, distinct materials. For instance, support flange 128 may be formed from a first material, such as a relatively low thermal conductivity metal (e.g., steel, including alloys thereof), while top cap 126 is formed from a second material, such as a relatively high thermal conductivity metal (e.g., aluminum, copper, a copper alloy, or an aluminum alloy). Top cap 126 may thus absorb and conduct heat faster or more readily than support flange 128.

In some embodiments, a spring bracket 108 biases shroud cover 106 and bimetallic thermostat 120 thereon upwardly. As shown, spring bracket 108 may include a mounting plate 140 and one or more biasing arms 142 extending therefrom. When assembled, bimetallic thermostat 120 is mounted or fixed to mounting plate 140. For instance, bimetallic thermostat 120 can be welded, clipped, or otherwise attached to mounting plate 140 with mechanical fasteners (e.g., screws or rivets), or a combination thereof. Biasing arms 142 may be resilient members, which generally urge mounting plate 140 upward. Spring bracket 108, including biasing arms 142, may be formed from any suitable high yield strength material. For instance, spring bracket 108 is formed of a stainless steel, full hard, or spring tempered material. Spring bracket 108 can be formed of other suitable high yield strength materials as well.

Generally, electric resistance heating coil assembly 100 includes a heat transfer disk 130. Heat transfer disk 130 is positioned on bimetallic thermostat 120 at distal end 122 of bimetallic thermostat 120. For example, heat transfer disk 130 may contact distal end 122 of bimetallic thermostat 120. Thus, heat transfer disk 130 may be in direct, thermal, conductive communication with bimetallic thermostat 120. Because heat transfer disk 130 is positioned at distal end 122 of bimetallic thermostat 120, heat transfer disk 130 may also be urged away from top surface 118 of spiral wound sheathed heating element 110. In particular, heat transfer disk 130 may be urged against the utensil on top surface 118 of spiral wound sheathed heating element 110 (e.g., due to the spring loading of bimetallic thermostat 120).

Heat transfer disk 130 or bimetallic thermostat 120 may be positioned concentrically with a center 119 of spiral wound sheathed heating element 110. Center 119 of spiral wound sheathed heating element 110 may be open, and spiral wound sheathed heating element 110 may extend circumferentially around heat transfer disk 130 or bimetallic thermostat 120 at center 119. Heat transfer disk 130 may also cover distal end 122 of bimetallic thermostat 120. In some embodiments, heat transfer disk extends above and over at least a portion of shroud 102, including shroud cover 106.

When assembled, heat transfer disk 130 may be positioned between bimetallic thermostat 120 and a utensil on top surface 118 of spiral wound sheathed heating element 110, and heat transfer disk 130 may contact the utensil. Heat transfer disk 130 may also include a flange 132 that extends downwardly towards shroud cover 106 towards shroud cover 106.

Figure 5:
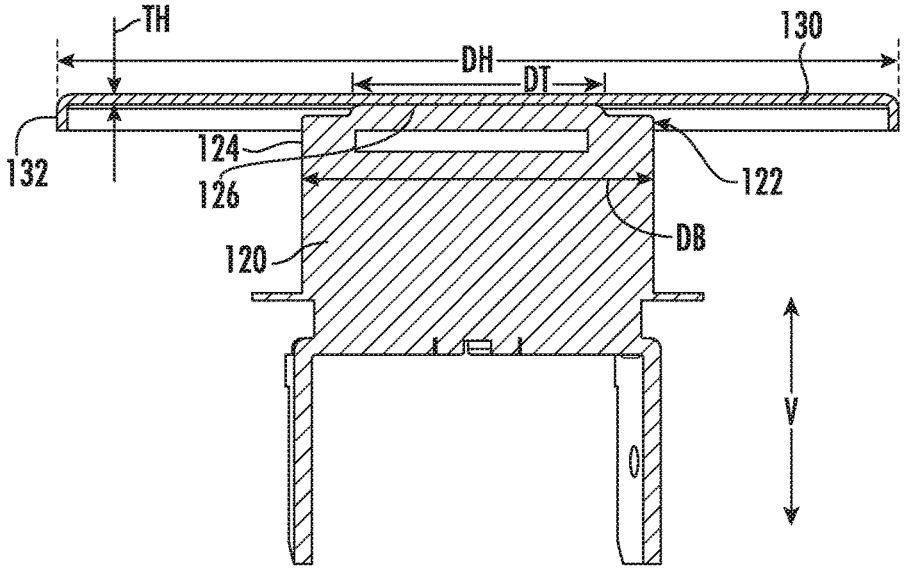
FIG. 5 provides a simplified, sectional view of a heat transfer disk and a bimetallic thermostat of the exemplary electric resistance heating coil assembly of FIG. 2.

Turning now to FIG. 5, FIG. 5 provides a simplified, sectional view of heat transfer disk 130 and bimetallic thermostat 120. As shown, bimetallic thermostat 120 includes a discrete base 124 and top cap 126 that is held on base 124. For instance, at least a portion of top cap 126 may extend above base 124 and define an uppermost surface of bimetallic thermostat 120 at distal end 122. In some embodiments, base 124 and top cap 126 are formed of, or include, distinct materials. For instance, base 124 may be formed from a substrate material, such as a thermally insulating or heat-resistant material (e.g., ceramic), while top cap 126 is formed from a second material, such as a relatively high thermal conductivity metal (e.g., aluminum, copper, a copper alloy, or an aluminum alloy). Top cap 126 may thus absorb and conduct heat faster or more readily than base 124.

When assembled, heat transfer disk 130 may be joined to bimetallic thermostat 120 at top cap 126. For example, heat transfer disk 130 may be friction welded, spot welded, seam welded, ultrasonic welded, or resistance welded to top cap 126 (e.g., to provide direct thermal conductive communication between bimetallic thermostat 120 and heat transfer disk 130). Heat transfer disk 130 may be formed of aluminum, copper, a copper alloy, or an aluminum alloy. Such materials advantageously facilitate conductive heat transfer between the utensil on top surface 118 of spiral wound sheathed heating element 110 and heat transfer disk 130. In certain embodiments, top cap 126 and heat transfer disk 130 may be formed from a common material, such as one of aluminum, copper, a copper alloy, or an aluminum alloy, in order to advantageously facilitate conductive heat transfer between bimetallic thermostat 120 and heat transfer disk 130, and facilitate the joining of heat transfer disk 130 to thermostat top cap 126.

Generally, heat transfer disk 130 may be sized to facilitate conductive heat transfer between a utensil on top surface 118 of spiral wound sheathed heating element 110 and bimetallic thermostat 120. For example, a diameter DH of heat transfer disk 130 may be larger than a diameter DT of top cap 126 of bimetallic thermostat 120 (e.g., in a plane that is perpendicular to the vertical direction V). Additionally or alternatively, diameter DH of heat transfer disk 130 may be larger than a maximum diameter DB defined by base 124 of bimetallic thermostat 120 (e.g., no less than two times greater in a plane that is perpendicular to the vertical direction V). Additionally or alternatively, the diameter DH of heat transfer disk 130 may be less than a diameter DC (FIG. 2) of center 119 of spiral wound sheathed heating element 110. The sizing of heat transfer disk 130 relative to bimetallic thermostat 120 may advantageously assist conductive heat transfer from the utensil on top surface 118 of spiral wound sheathed heating element 110 to bimetallic thermostat 120.

In certain example embodiments, the diameter DH of heat transfer disk 130 may be no less than one inch (1") and no greater than one and a half inches (1.5"). Conversely, a thickness TH of heat transfer disk 130 (e.g., perpendicular to the diameter DH of heat transfer disk 130) may be no less than two hundredths of an inch (0.02") and no greater than five hundredths of an inch (0.05"). Additionally or alternatively, a ratio of the diameter DH of heat transfer disk 130 to the thickness TH of heat transfer disk 130 may be no less than twenty (20) and no greater than seventy-five (75). Such sizing of heat transfer disk 130 may advantageously assist conductive heat transfer from the utensil on top surface 118 of spiral wound sheathed heating element 110 to bimetallic thermostat 120.

Figure 7:
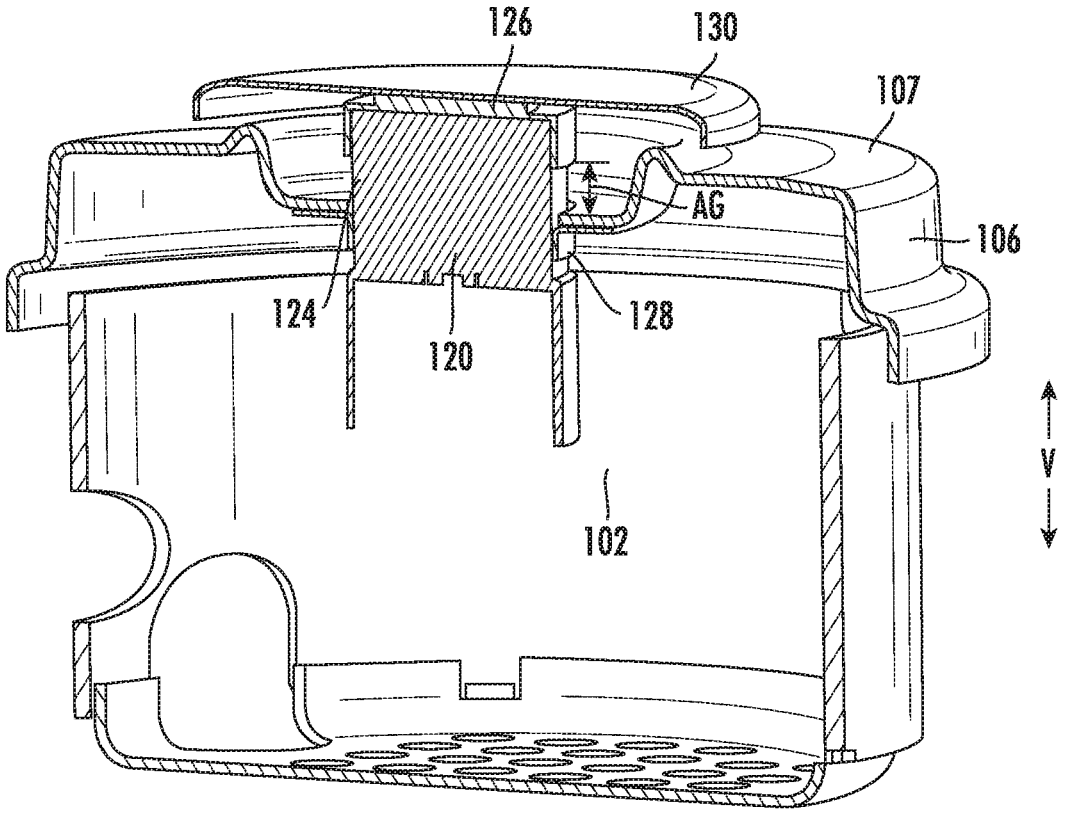
FIG. 7 provides a simplified, sectional view of a portion of an electric resistance heating coil assembly according to exemplary embodiments of the present disclosure.
Figure 8:
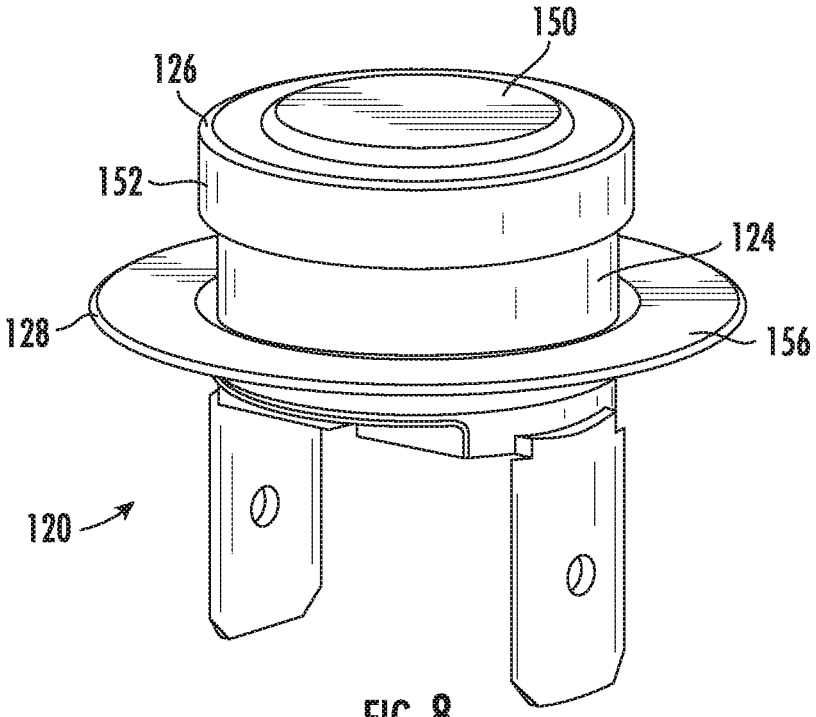
FIG. 8 provides a perspective view of the exemplary bimetallic thermostat of FIG. 7.
Figure 9:
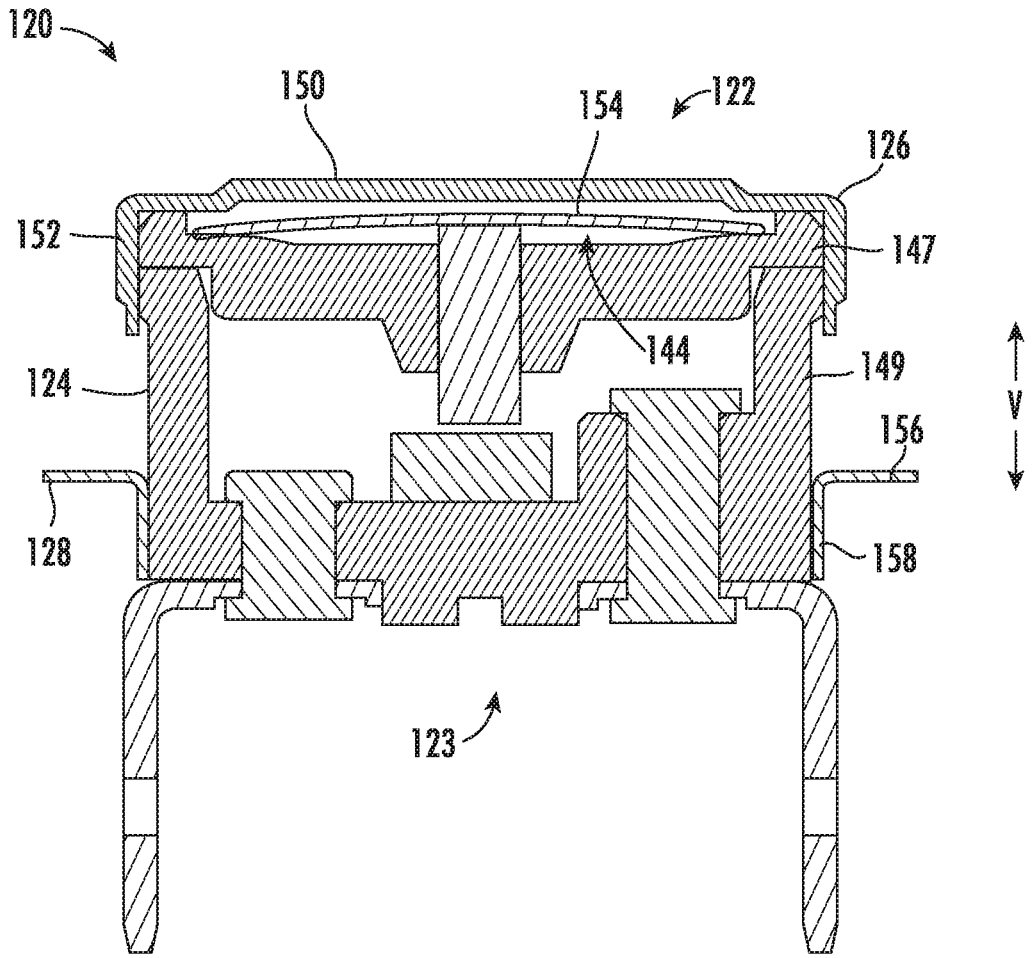
FIG. 9 provides a sectional view of the exemplary bimetallic thermostat of FIG. 7.

Turning now to FIGS. 7 through 9, various views are provided of portions of electric resistance heating assembly 100. As shown, top cap 126 may be seated on top of or over base 124. In some embodiments, top cap 126 is press fitted on top of base 124. Optionally, top cap 126 may cover multiple segments of base 124, such as an upper frame 147 and a lower frame 149.

In some embodiments, top cap 126 includes an upper surface 150 that extends across base 124 and a cap wall 152 that extends downwardly from upper surface 150 around base 124. Optionally, base 124 may define a central opening 144 (e.g., within which a bimetallic disk 154 is disposed). Thus, the upper surface 150 of top cap 126 may extend across and close central opening 144 while cap wall 152 contacts base 124, holding upper surface 150 in place.

As noted above, when assembled, shroud cover 106 is positioned below top cap 126. In particular, shroud cover 106 may be spaced apart from top cap 126. Although both shroud cover 106 and top cap 126 are generally attached to base 124, shroud cover 106 may be out of contact or conductive thermal engagement with top cap 126. A vertical air gap AG may be defined between top cap 126 and shroud cover 106. In some such embodiments, support flange 128 is also spaced apart from top cap 126. For instance, support flange 128 may be positioned below shroud cover 106 or vertical air gap AG.

In certain embodiments, support flange 128 includes an attachment lip 156 and a flange wall 158. As shown, attachment lip 156 may extend radially outward from base 124 (e.g., below shroud cover 106 or vertical air gap AG). Additionally or alternatively, flange wall 158 may extend from attachment lip 156 (e.g., downward) around base 124. Optionally, flange wall 158 may be held to an outer surface of base 124 at an interior end 123 that is opposite the distal end 122. For instance, flange wall 158 may be press fitted to a bottom portion of base 124 (e.g., at lower frame 149). Thus, attachment lip 156 of support flange 128 may extend (e.g., radially) from base 124 apart from top cap 126 while flange wall 158 contacts base 124 below and apart from cap wall 152, holding attachment lip 156 in place. When assembled base 124 may separate all of support flange 128 and top cap 126, preventing direct contact or thermal conduction between the support flange 128 and top cap 126. Advantageously, thermostat 120 may prevent heat from being conducted between top cap 126 and support flange 128 or shroud cover 106. In turn, heat (e.g., radiative heat) absorbed at shroud cover 106 may be prevented from unduly influencing the temperature of (or detected at) top cap 126.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An electric resistance heating coil assembly, comprising:

a spiral wound sheathed heating element having a first coil section and a second coil section;

a thermostat comprising a base and a top cap held against the base, the base defining a central opening and the top cap extending across and closing the base, the thermostat being connected in series between the first and second coil sections of the spiral wound sheathed heating element, the thermostat being spring loaded such that a distal end of the thermostat is urged away from a top surface of the spiral wound sheathed heating element; and a shroud cover mounted to the thermostat below the top cap, the shroud cover being spaced apart from the top cap, wherein a vertical air gap is defined between the top cap and the shroud cover, wherein the thermostat further comprises a support flange held on the base apart from the top cap.

2. The electric resistance heating coil assembly of claim 1, wherein the shroud cover is joined to the thermostat at the support flange.

3. The electric resistance heating coil assembly of claim 2, wherein the support flange is positioned below a top surface of the spiral wound sheathed heating element.

4. The electric resistance heating coil assembly of claim 2, wherein the support flange is positioned below the vertical air gap.

5. The electric resistance heating coil assembly of claim 1, further comprising a heat transfer disk joined to the thermostat at the top cap, the heat transfer disk positioned concentrically with a center of the spiral wound sheathed heating element.

6. The electric resistance heating coil assembly of claim 1, further comprising a spring bracket mounted to the thermostat below the shroud cover.

7. The electric resistance heating coil assembly of claim 2, wherein the support flange comprises a first material, and wherein the top cap comprises a second material distinct from the first material.

8. The electric resistance heating coil assembly of claim 7, wherein the first material is steel, and wherein the second material is aluminum, copper, a copper alloy, or an aluminum alloy.

9. The electric resistance heating coil assembly of claim 7, further comprising a heat transfer disk joined to the thermostat at the top cap, the heat transfer disk comprising the second material.

10. The electric resistance heating coil assembly of claim 9, wherein the heat transfer disk is friction welded, spot welded, seam welded, ultrasonic welded, or resistance welded to the top cap.

11. A cooktop appliance, comprising:

a heating element defining a heating zone; and a sensor support assembly positioned within the heating zone of the heating element, the sensor support assembly comprising a shroud cover, and a thermostat mounted to the shroud cover, the thermostat comprising a base and a top cap held against the base, the base defining a central opening and the top cap extending across and closing the base, the top cap being positioned above the shroud cover and spaced apart therefrom, wherein a vertical air gap is defined between the top cap and the shroud cover, wherein the thermostat further comprises a support flange held on the base apart from the top cap.

12. The cooktop appliance of claim 11, wherein the shroud cover is joined to the thermostat at the support flange.

13. The cooktop appliance of claim 12, wherein the support flange is positioned below a top surface of the heating element.

14. The cooktop appliance of claim 12, wherein the support flange is positioned below the vertical air gap.

15. The cooktop appliance of claim 11, further comprising a heat transfer disk joined to the thermostat at the top cap, the heat transfer disk positioned concentrically with a center of the heating element.

16. The cooktop appliance of claim 11, wherein the sensor support assembly further comprises a spring bracket mounted to the thermostat below the shroud cover.

17. The cooktop appliance of claim 12, wherein the support flange comprises a first material, and wherein the top cap comprises a second material distinct from the first material.

18. The cooktop appliance of claim 17, wherein the first material is a ceramic, and wherein the second material is aluminum, copper, a copper alloy, or an aluminum alloy.

19. The cooktop appliance of claim 17, further comprising a heat transfer disk joined to the thermostat at the top cap, the heat transfer disk comprising the second material.

20. The cooktop appliance of claim 19, wherein the heat transfer disk is friction welded, spot welded, seam welded, ultrasonic welded, or resistance welded to the top cap.

* * * * *